US008020722B2

(12) United States Patent
Richards et al.

(10) Patent No.: US 8,020,722 B2
(45) Date of Patent: Sep. 20, 2011

(54) SEAMLESS MULTI-SECTION PRESSURE VESSEL

(76) Inventors: Kevin W. Richards, Mantua, UT (US); Nathan G. Christensen, Logan, UT (US)

( * ) Notice: Subject to any disclaimer, the term of this patent is extended or adjusted under 35 U.S.C. 154(b) by 1002 days.

(21) Appl. No.: 11/841,605

(22) Filed: Aug. 20, 2007

(65) Prior Publication Data

US 2009/0050635 A1 Feb. 26, 2009

(51) Int. Cl.
*F17C 1/00* (2006.01)

(52) U.S. Cl. ..... 220/584; 220/581; 220/501; 220/555; 220/4.12

(58) Field of Classification Search ..... 220/584, 220/675, 4.12, 555, 553, 501, 581
See application file for complete search history.

(56) References Cited

U.S. PATENT DOCUMENTS

| | | | | |
|---|---|---|---|---|
| 1,668,179 | A | 5/1928 | Williams | |
| 2,106,494 | A * | 1/1938 | Debor | 220/584 |
| 2,171,972 | A | 9/1939 | Debor | |
| 2,171,973 | A | 9/1939 | Debor | |
| 2,341,044 | A | 2/1944 | Jackson et al. | |
| 2,672,254 | A * | 3/1954 | Boardman | 220/565 |
| 2,920,784 | A * | 1/1960 | Boardman | 220/565 |
| 3,414,153 | A | 12/1968 | Leroux | |
| 3,528,582 | A | 9/1970 | Rigollot | |
| 3,608,767 | A * | 9/1971 | Elliott et al. | 220/4.12 |
| 3,645,415 | A * | 2/1972 | Phelps | 220/565 |
| 4,062,356 | A | 12/1977 | Merrifield | |
| 4,282,823 | A | 8/1981 | Santi | |
| 4,343,409 | A * | 8/1982 | Silver | 220/675 |
| 4,374,478 | A | 2/1983 | Secord et al. | |
| 4,615,452 | A * | 10/1986 | Lederer et al. | 220/566 |
| 4,819,426 | A | 4/1989 | Singer et al. | |
| 4,932,546 | A * | 6/1990 | Stannard | 220/581 |
| 4,946,056 | A * | 8/1990 | Stannard | 220/584 |
| 5,284,267 | A | 2/1994 | Polletta et al. | |
| 5,285,921 | A * | 2/1994 | Lai | 220/592.25 |
| 5,564,272 | A | 10/1996 | Warner et al. | |
| 5,564,587 | A * | 10/1996 | Falk et al. | 220/501 |
| 5,577,630 | A | 11/1996 | Blair et al. | |
| 5,584,289 | A | 12/1996 | Wise | |
| 5,613,490 | A | 3/1997 | Mayes et al. | |
| 5,615,702 | A | 4/1997 | Dawans et al. | |

(Continued)

FOREIGN PATENT DOCUMENTS

DE 3225930 A1 1/1984

(Continued)

OTHER PUBLICATIONS

MSA North America, Air Cylinders, 4 pages, http://www.msanorthamerica.com/catalog/product733.html, © MSA 2006.

*Primary Examiner* — Anthony Stashick
*Assistant Examiner* — Christopher McKinley
(74) *Attorney, Agent, or Firm* — Warren M. Pate, LLC

(57) ABSTRACT

A lightweight, ergonomically beneficial, hydrodynamic, and volumetrically efficient hybrid pressure vessel having at least two longitudinally extending, semi-cylindrical sections with flattened rib portions at a common interface between the sections. Additional longitudinally extending sections may be employed to provide additional internal volume. One or more apertures extend through the ribs to provide communication between sections. The pressure vessel comprises a cast metal material, optionally including exterior reinforcing structure for containing internal pressure.

26 Claims, 8 Drawing Sheets

U.S. PATENT DOCUMENTS

| | | | | |
|---|---|---|---|---|
| 5,651,474 | A | 7/1997 | Callaghan et al. | |
| 5,704,512 | A * | 1/1998 | Falk et al. | 220/501 |
| 5,787,920 | A * | 8/1998 | Krasnov | 137/255 |
| 5,865,923 | A * | 2/1999 | Johnson | 156/172 |
| 5,927,537 | A * | 7/1999 | Falk et al. | 220/501 |
| 5,944,215 | A * | 8/1999 | Orlowski | 220/501 |
| 6,095,367 | A * | 8/2000 | Blair et al. | 220/581 |
| 6,190,441 | B1 * | 2/2001 | Czabala et al. | 96/130 |
| 6,220,779 | B1 * | 4/2001 | Warner et al. | 403/381 |
| 6,412,650 | B1 * | 7/2002 | Warner | 220/4.12 |
| 6,418,962 | B1 | 7/2002 | Wozniak et al. | |
| 6,519,950 | B2 | 2/2003 | Pelloux-Gervais et al. | |
| D483,859 | S | 12/2003 | Omholt | |
| 6,676,163 | B2 | 1/2004 | Joitescu et al. | |
| 6,708,719 | B2 | 3/2004 | Idoguchi | |
| 6,786,229 | B1 | 9/2004 | Friedlmeier et al. | |
| 6,883,536 | B2 | 4/2005 | Hervio et al. | |

FOREIGN PATENT DOCUMENTS

| | | | |
|---|---|---|---|
| EP | 1061307 | A1 | 12/2000 |
| FR | 1290641 | B | 3/1962 |
| GB | 2040430 | A | 8/1980 |
| WO | 9809876 | A1 | 3/1998 |
| WO | 0024641 | A1 | 5/2000 |
| WO | 02102657 | A1 | 12/2002 |
| WO | 03016777 | A1 | 2/2003 |

* cited by examiner

SEAMLESS MULTI-SECTION PRESSURE VESSEL

FIELD OF THE INVENTION

The invention relates generally to pressure vessels. More particularly, embodiments of the invention relate to a volumetrically efficient, seamless, multi-section vessel suitable for, without limitation, holding a pressurized gas such as an air supply for underwater diving as well as in hostile work or rescue environments.

BACKGROUND

The use of pressurized gas vessels, or air tanks, for breathable primary or supplemental air supplies has become widely accepted in recreational, industrial and public safety arenas. Air tanks are used underwater for recreational underwater diving, termed "SCUBA" (Self Contained Underwater Breathing Apparatus) diving, which is also applicable to industrial or commercial settings for ship repair, off-shore drilling operations, underwater salvage, pipeline repair, as well as to military applications, search and rescue operations, and underground environments, such as mines. In above-water applications, an air tank used as a Self-Contained Breathing Apparatus (SCBA) is invaluable for personnel working in an environment that poses an Immediate Danger to Life or Health (IDLH). SCBAs are used by fire fighters entering into smoke filled or toxic environments, police working at contaminated crime scenes, underground mine rescue teams entering "bad air" or smoke, HAZMAT teams working in contaminated environments, and industrial maintenance personnel working in confined spaces or in toxic environments. SCBAs are also strategically placed in chemical plants, laboratories, refineries, nuclear facilities, paper mills and underground mines for employees to use as a "self-rescuer" during an emergency.

FIG. 1 depicts a conventional pressure vessel or air tank 10 configured as a cylinder 12 with a domed, or hemispherical, top 18 and a domed, or hemispherical, bottom 20. A rubber or plastic boot 16 disposed over the bottom 20 both protects and stabilizes the cylinder 12 when resting on a surface in an upright position. A gas under pressure such as a breathable air mixture or, less commonly, oxygen, is injected and expelled from the cylinder 12 via a primary valve 14.

Cylinders vary in size depending upon the application. A self-rescue air cylinder may be relatively small; for example a cylinder with an 8 cubic foot equivalent capacity at 3000 PSI, may be 4 inches in diameter and 10 inches long, and can be used to supply sustainable air for about 5 minutes. This provides the user enough time to retreat from a small building or enclosure to a safe environment. An air supply lasting 15 minutes is the minimum requirement for an SCBA to be approved by the National Institute for Occupational Health and Safety (NIOSH) for entering IDLH environments. In order for a SCBA to meet the 15 minute standard the device must have a capacity of 20-24 cubic feet equivalent, when the air is pressurized to 3000 PSI. This requires a single air cylinder with dimensions approximately 5 inches in diameter and 18 inches in length, or the breathable air volume can be split between multiple, smaller cylinders. However, the bulk and size of either of these configurations may become a hindrance if the user is attempting to perform tasks in, or trying to escape from, a confined space. Fire fighters and mine rescue personnel use incrementally larger configurations of SCBAs, allowing for extended forays into IDLH environments, re-supplying breathable air to fellow rescuers or the ability to share breathable air with a victim stranded in the hostile environment. Most SCUBA air cylinders are a so-called standard "80," or a cylinder capable of holding 80 cubic feet of air. Thus, if an additional volume of breathable air is required, most divers will use two tanks or "double-up" tanks. However, 100 cubic foot and larger tanks are also available. The 100 cubic foot tanks are extremely large and, when made from steel, weigh more than 40 lbs. Double tanks or the large, 100 cubic foot tanks are manageable underwater, but can significantly reduce the diver's mobility when negotiating around or within structures such as, by way of example only, rocks or coral, offshore platforms, or sunken ships. Additionally, smaller users may not be physically able to shoulder or handle the larger tanks or multi-tank configurations while above water.

Further, with respect to the use of multiple cylindrical tanks, stacking or aligning cylindrical structures in a single row is an inefficient use of space. Considering cylinders with the same diameter, each cylinder contacts the laterally adjacent cylinder or cylinders tangentially along a line of contact, creating a substantially triangular void between the cylinders on either side of the line of contact. This issue has been addressed in a number of applications for improving the volumetric efficiency of multiple cylinders used for storing propane or natural gas. Most of these multi-cylinder pressure vessels are formed using rolled steel sections which are mated and welded together, such as those described in U.S. Pat. No. 4,946,056 to Stannard, U.S. Pat. No. 3,528,582 to Rigollot and U.S. Pat. No. 3,414,153 to Leroux. Another method used to form multi-cylinder pressure vessels includes interlocking sections, such as a clip and lobe arrangement, shown in U.S. Pat. No. 6,220,779 to Warner et al. U.S. Pat. No. 5,944,215 to Orlowski describes a volumetrically efficient multi-cylinder vessel that may be formed from a plastic as a one-piece or unitary structure. A second one-piece plastic structure designed for use in automotive applications as a vacuum pressure vessel is described in U.S. Pat. No. 4,343,409 to Silver. Each of these plastic vessels are designed for relatively low pressure or vacuum use, the former being designed for at least 5 atmospheres or approximately 75 psi and the latter being described to provide "adequate implosion resistance" when subjected to a vacuum sufficient to actuate automotive features like headlight door covers.

A diving tank is typically attached to a pack-frame using a clamping ring, or the tank is placed into a "clamshell" structure that fully encases the tank and is worn on the diver's back. Originally the pack-frame accommodated the air tank only and the user would need a separate weight-belt and inflatable vest or BC (buoyancy compensator) to achieve neutral or slightly negative buoyancy while in the water. Modern tank packs are now universally referred to as a BC and are configured more like a vest which includes the air tank clamping ring, integrated regulators and gauges, an inflatable bladder, weights and pockets for numerous diving accessories. With both the older pack-frame and a modern BC, the air tank extends well above the diver's back and, since it is behind the diver and out of sight, the diver can easily misjudge the clearance necessary to enter an opening in a reef, cave or wreck, causing damage to the air tank or possibly trapping the diver. This problem is exacerbated when using large or multiple tanks.

Divers manage underwater risk in several ways. One way is by "slinging" their air tank over a single shoulder when diving in a confined space such as wreck or cave, allowing the tank to dangle below the diver, where the tank can be watched and manually manipulated around obstacles. A second way to manage risk and which has been adopted as a modern standard safety feature is the provision of an emergency regulator. Originally, tanks included a single hose from the primary valve to the diver's mouthpiece or regulator. Currently, an additional hose for a backup regulator or "octopus" is attached to the tank. The octopus is available to the diver if the primary regulator fails or malfunctions and may be offered to another diver who is short of air or otherwise in trouble.

It would be desirable to offer a portable air tank system that is volumetrically more efficient than conventional multi-tank systems, is of reduced overall weight for easy handling, is less obtrusive, as well as more compact and hydrodynamic.

BRIEF SUMMARY OF THE INVENTION

Embodiments of the present invention comprise a pressure vessel including at least two longitudinally extending sections, each including a side wall, a first substantially hemispherical end wall and a second substantially hemispherical end wall. A rib is formed at an interface between the sections and includes at least one aperture extending therethrough. The at least two laterally adjacent sections and the rib comprise a seamless, unitary structure of a metal material.

DETAILED DESCRIPTION

Figure 1:
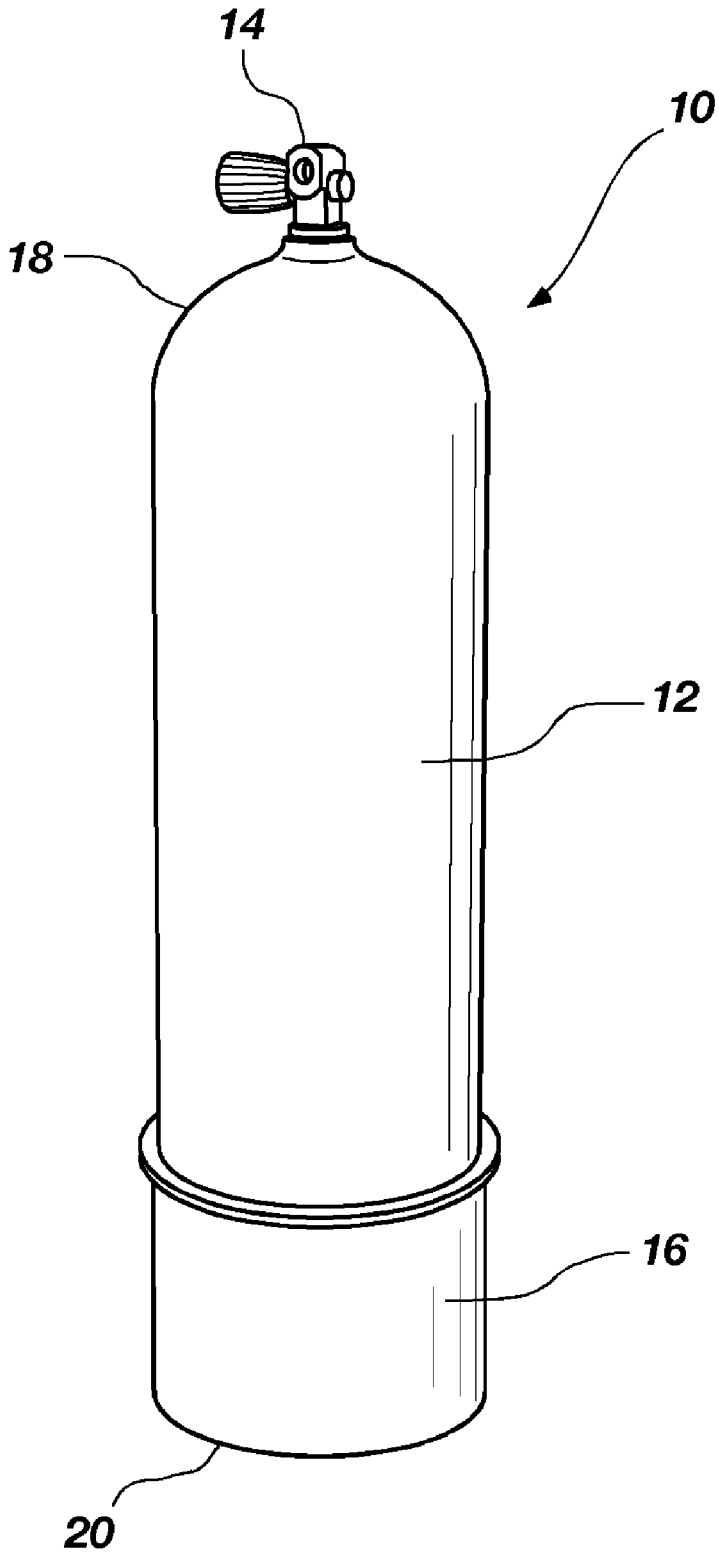
FIG. 1 is an illustration of a standard Scuba or SCBA air cylinder.
Figure 2:
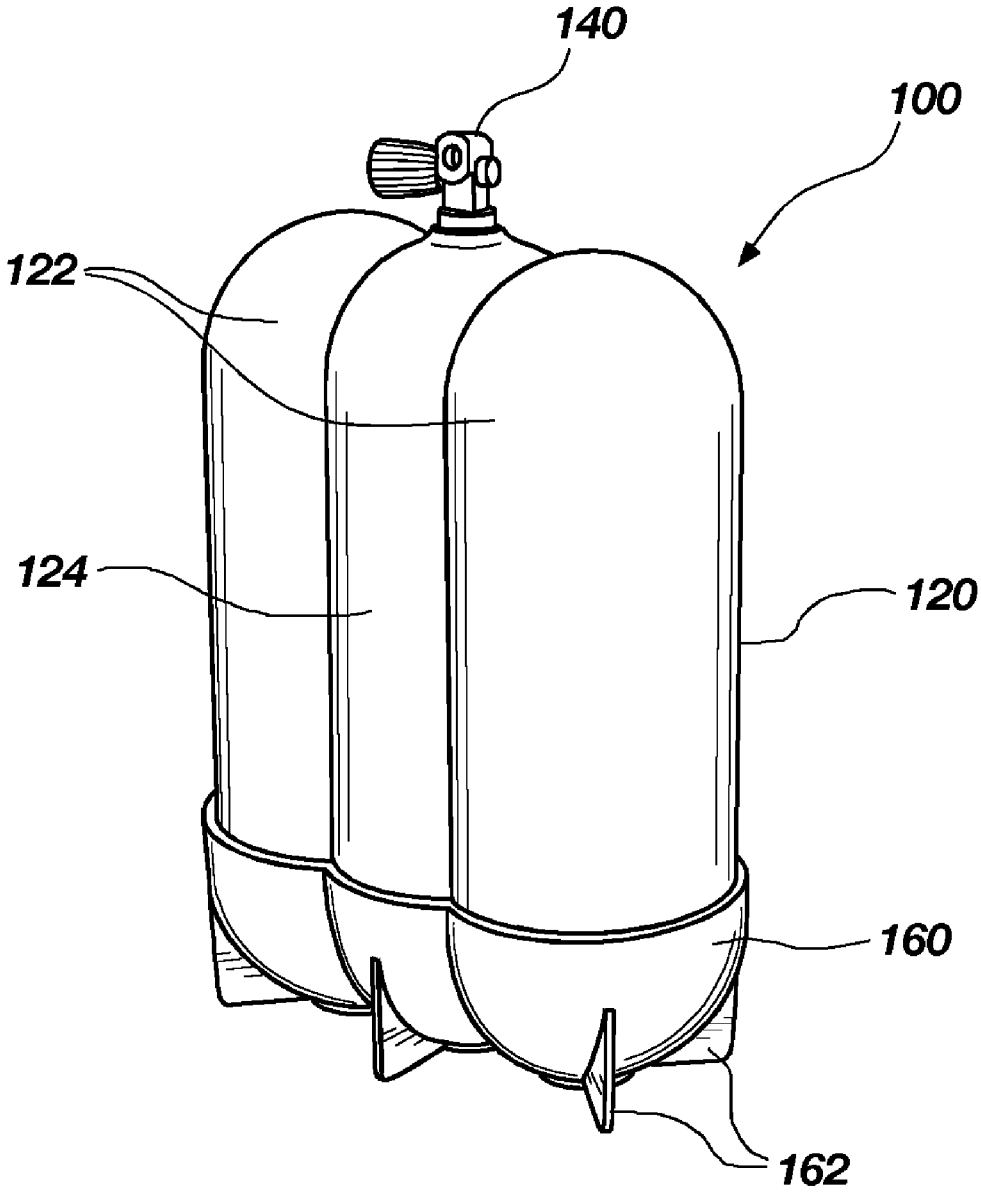
FIG. 2 is an embodiment of a hybrid pressure vessel of the present invention.
Figure 3A:
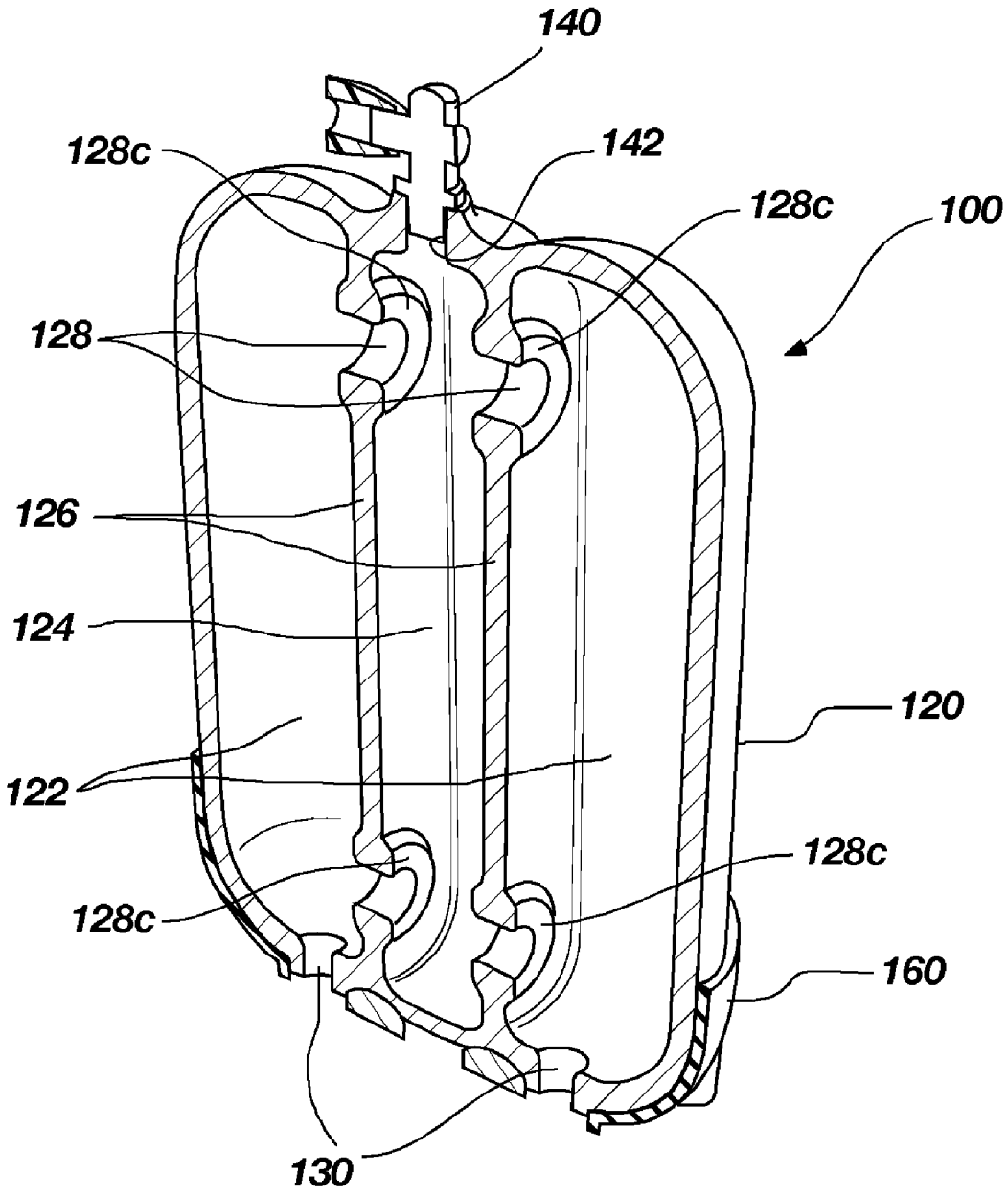
FIG. 3A is a longitudinal section view of the embodiment of FIG. 2, taken parallel to a major plane of the hybrid pressure vessel.
Figure 3B:
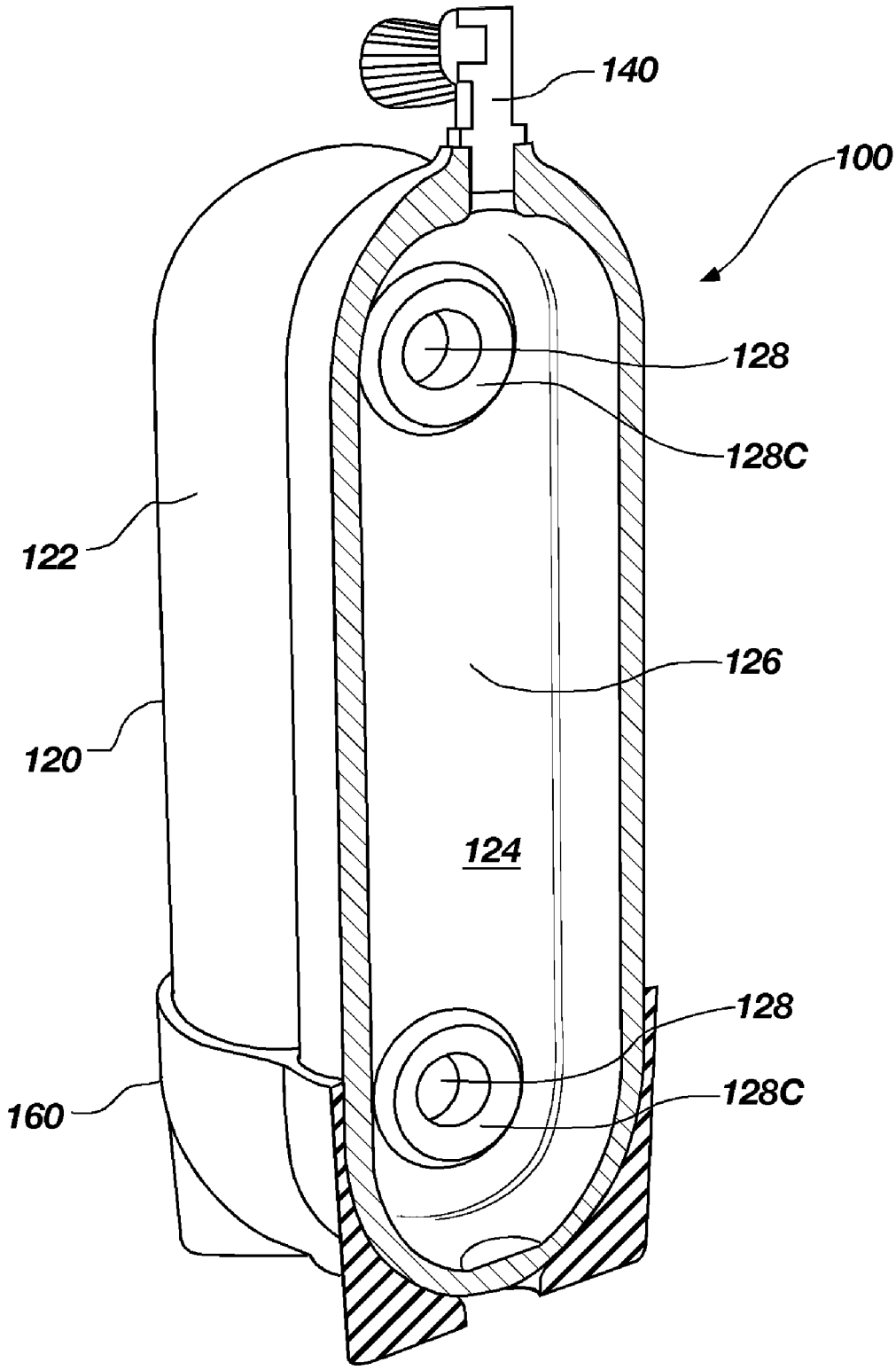
FIG. 3B is a longitudinal section view of the embodiment of FIG. 2, taken through the center of the hybrid pressure vessel and transverse to the major plane thereof.
Figure 3C:
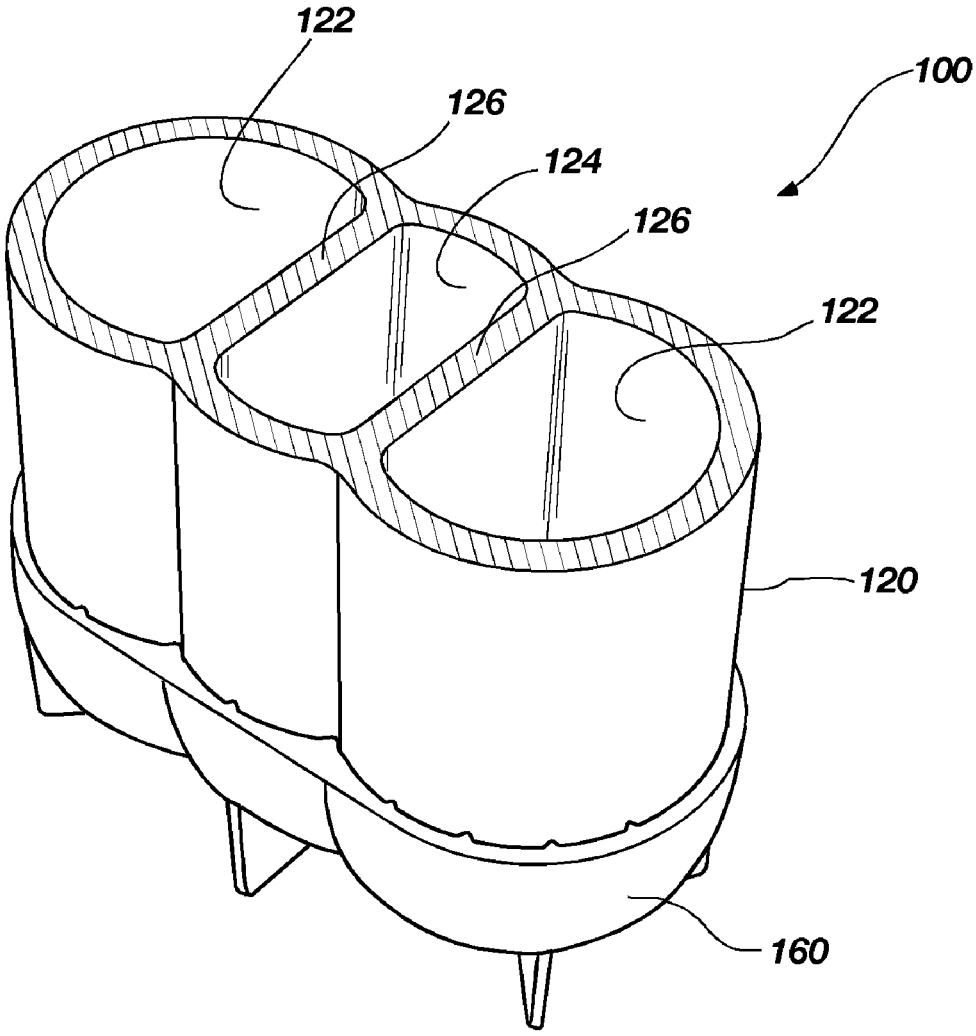
FIG. 3C is a horizontal section view of the embodiment of FIG. 2.

Embodiments of the present invention relate to a volumetrically efficient air tank which may be manufactured using lightweight material, has a lower and more ergonomic profile than a conventional, cylindrical air tank of similar volume, and exhibits better hydrodynamics. Embodiments of the invention comprise a seamless unitary structure of metal material, configured to operably contain an internal gas pressure of at least about 3000 psi at ambient atmospheric external pressure.

One embodiment of the present invention comprises a volumetrically efficient hybrid pressure vessel having at least two sections. The outer sections or lobes are largely cylindrical with a flattened side portion at a common interface, or rib, with a laterally adjacent section. An intermediate section or sections, if present, have arcuately curved outside surfaces and common flat portions at both interfaces with laterally adjacent sections. When looking at a transverse cross-section of the intermediate sections of the pressure vessel, these cross-sections may be characterized as substantially square, rectangular, or trapezoidal. More than two cylinders, or even more than one row of cylinders, may be employed. A different number of sections may be disposed in an additional row of cylinders, such a row being offset from the first row. With such an arrangement, wasted space between pressure vessel sections may be minimized as the sections of the additional row are partially received in recesses between sections of the first row.

Communication ports or apertures may be provided through each rib, enabling each section of the pressure vessel to be filled or discharged from a single primary valve mounted to one section. Further, the presence of the holes serves to equalize pressure between sections, enabling a relatively high internal gas pressure to be safely accommodated. In addition, placement of the holes in lateral alignment, as shown, provides, in combination with other apertures extending through a wall of the pressure vessel in the form of an external valve port in a central section and external clean-out ports in outer sections (assuming a three-section pressure vessel) the ability to employ a single piece core in a mold employed to cast the pressure vessel. This is effected by the use of three external core locating features extending through the previously mentioned external ports, in combination with portions of the core extending through the internal, inter-section ports, to accurately position the single piece core.

The shape and structure of the ports or apertures is also a significant feature of embodiments of the present invention. Reinforced, elliptical ports or apertures reduce stress on the structure of the pressure vessel to acceptable levels. The aspect ratio (height to width) of the ellipse is dependent upon the thickness of the side walls, domed ends and internal ribs employed in the pressure vessel. An ellipse is particularly suitable for the port or aperture shape, as internal stress from gas pressure acting on the side walls along the middle, longitudinally extending portion of a cylinder, termed tangential or "hoop" stress, is approximately two times greater than the longitudinal or axial stress acting on the ends of the cylinder. However, the invention is not so limited, and other aperture or port shapes are contemplated as within the scope of the present invention.

The pressure vessel of the present invention may be formed, by way of example and not limitation, as a monolithic or unitary structure using semi-permanent mold, permanent mold with sacrificial sand core, or investment casting methods. The pressure vessel may be cast of a low melting point alloy of aluminum using, for example, a semi-permanent mold or a permanent mold with a sacrificial sand core. Other, high melting point alloys of a steel, such as a stainless steel, may be used with investment casting techniques. Other casting methods and metal materials are also contemplated as suitable for implementing embodiments of the invention.

A finished aluminum alloy pressure vessel will be significantly lighter than a similar steel structure. It is contemplated that the weight of the structure may be further minimized by varying the thickness of the pressure vessel walls. As noted above, the stress acting on the side walls along the middle, longitudinally extending portion of a cylinder is referred to as the tangential stress or "hoop" stress and is approximately two times greater than the longitudinal or axial stress acting on the ends of the cylinder. Considering this fact, it is contemplated to reduce the thickness of the end walls in relation to the wall thickness of the side walls of cylinders of the pressure vessel. Additionally, the thickness of the side walls may be reduced if the section is then reinforced with a filament-wound belt. The belt can be constructed using a light weight material such as fiberglass, graphite, Kevlar, or a combination of materials. In order to avoid gaps formed under the filament-wound belt, the outside surface formed at the junctions between sections must be substantially planar. This may be accomplished by providing lightweight shims configured to fill the gaps between the adjacent sections on either side of each interface, or by configuring intermediate sections of the pressure vessel such that the outer surface is planer. Filament-wound pressure vessels offer an optimal capacity to weight ratio and are ideal for above-water SCBA applications.

The volumetrically efficient configuration of embodiments of the present invention enables a user to store more breathable air in a smaller, less obtrusive pressure vessel than is possible with conventional pressure vessel designs. Since the contained volume of air is distributed across a series of semi-cylindrical sections, the present invention offers a thinner, or lower, profile than a conventional air cylinder. The low profile pressure vessel reduces the user's entrapment risk when entering a confined space or an area with reduced clearance. Additionally, the semi-cylindrical sections can be formed where a center point of each section lies on a shallow arc. This allows the tanks to be substantially contoured around a user's back, further reducing the distance the pressure vessel extends away from the user.

The pressure vessels of the present invention offer improved hydrodynamics in comparison to a conventional air cylinder, due to its lower profile, shorter length and closer conformity to a diver's body. A conventional air cylinder protruding above the user's back has an effect similar to the rudder of a sailboat in that; as water moves past the cylinder, the cylinder tends to "steer" the diver. While the propensity of the air cylinder to steer a diver is negligible under most circumstances, it can be significant if the diver is swimming across or against a strong current, or if the diver is using an underwater sled or other propulsion device.

The pressure vessel of the present invention has been broadly discussed as a vessel for breathable air. However, it is contemplated that the pressure vessel can be used to store other gases or liquids for other applications including, medical gases, welding gas, automotive or aerospace fuel cells, etc.

FIGS. 2 and 3A-C depict an embodiment of the pressure vessel 100 of the present invention formed with a seamless metal body 120 including two outer lobes or sections 122 and an intermediate section 124. Metal body 120 may be formed from an aluminum alloy or a steel, including without limitation a stainless steel. Each section is substantially cylindrical with a flat portion at the common interface between the sections. Each common interface extends substantially entirely longitudinally along a boundary between laterally adjacent sections, forming a structural rib 126 between the sections. Communication ports 128 are provided in the ribs 126, allowing gas to move between sections and evenly distribute the pressure within pressure vessel 100. As noted above and as depicted in FIG. 3, communication ports 128 are of elliptical transverse cross-section (on-half of each ellipse being shown in the drawing figure), with the longer dimension of the ellipse oriented transverse to the longitudinal axes of the sections, and are each surrounded by a reinforcing collar 128C. Clean-out ports 130 at ends of the outer sections 122 are used to remove a temporary sand core after casting. The clean-out ports can be sealed with a pressure-fit plug, or a threaded bung. A primary valve 140 (shown schematically) for filling pressure vessel 100 with gas and dispensing gas therefrom is, by way of example only threaded into valve port 142 of the intermediate section 124. A plastic or vinyl boot 160 having struts or fins 162 extending therefrom caps the lower ends of sections 122 and 124 to protect and stabilize the pressure vessel 100 when placed upright on a supporting surface.

Figure 4A:
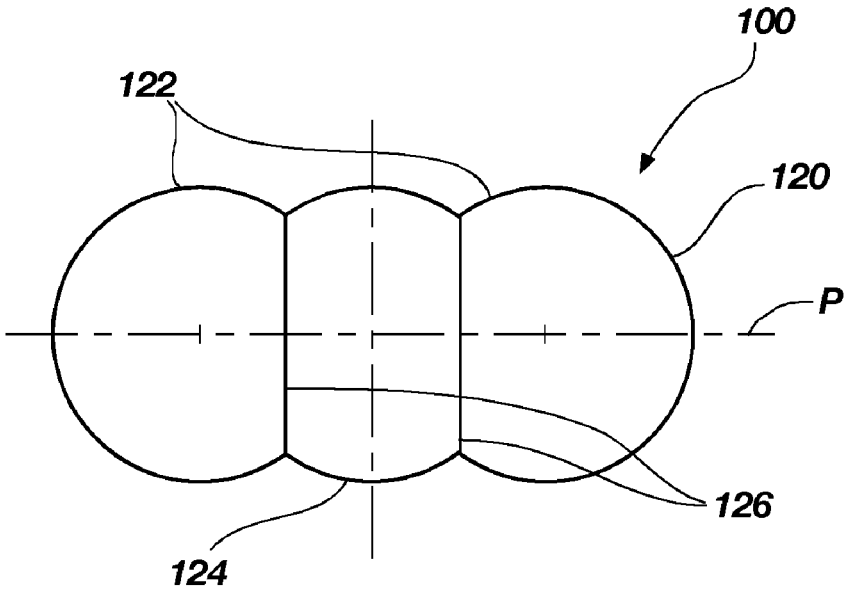
FIG. 4A is a cross-section of a hybrid pressure vessel having the center-point of each section aligned linearly.
Figure 4B:
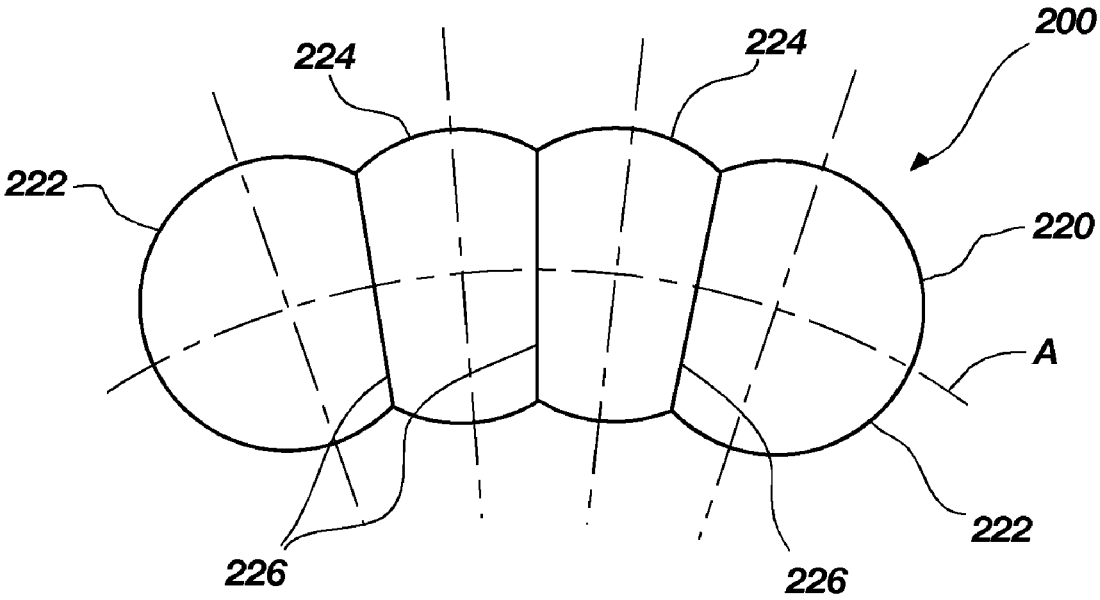
FIG. 4B is a cross-section of a hybrid pressure vessel having the center-point of each section on an arc.

FIG. 4A is a schematic cross-section of a metal body 120 of the pressure vessel 100, showing the outer sections 122 and the intermediate section 124 with center points thereof disposed on a single plane P. FIG. 4B is a cross-section of a metal body 220 of a pressure vessel 200 wherein the center point of each of the outer sections 222 and the two intermediate sections 224 fall on an arc A. The pressure vessel 200 having sections 222 and 224 formed on an arc provides advantages including conforming to the body (back) of the user, improved hydrodynamics and is a more ergonomically beneficial package. The pressure vessel 200 has, by way of example and not limitation, four interdependent sections 222, 224 connected along longitudinally extending ribs 226. It is contemplated as within the scope of the present invention to include additional, laterally adjacent sections or to include a second group of laterally adjacent sections substantially superimposed over the first group of sections, with the sections of the second group laterally shifted with respect to those of the first group and extending partially into spaces between the sections of the first group.

Figure 5A:
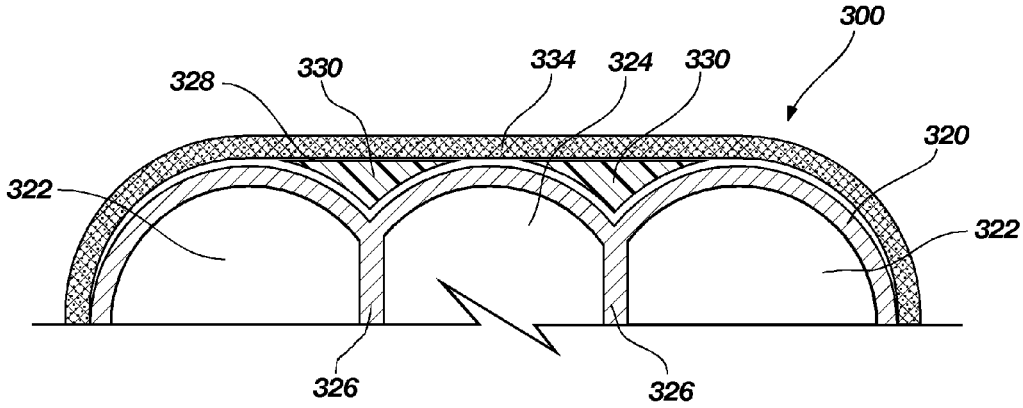
FIG. 5A is a partial section view of another embodiment of a hybrid pressure vessel of the present invention including spacers and a reinforcement belt.
Figure 5B:
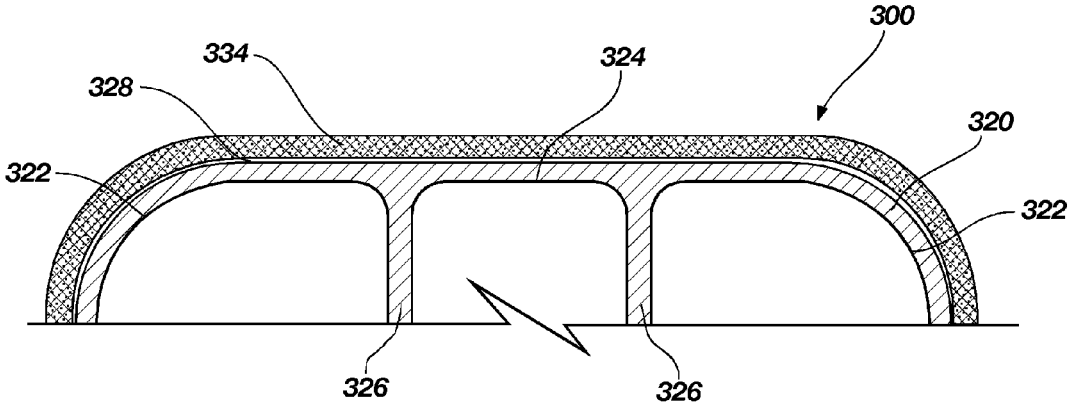
FIG. 5B is a partial section view of an embodiment of a hybrid pressure vessel of the present invention where the exterior surface of the intermediate section is cast substantially planar and reinforced with a filament wound belt.

Each of FIGS. 5A and 5B are embodiments of the present invention including features which may be employed to further reduce the weight of a pressure vessel 300 according to the present invention. The pressure vessel 300 is cast from aluminum or an alloy thereof, or a steel with a reduced side wall thickness, and is externally reinforced against the effects of pressure internal to pressure vessel 300 with a light weight belt 334. The belt 334 is filament-wound using a material such as glass, graphite, or Kevlar® fibers, impregnated with an epoxy. Belt 334 covers the laterally outer, arcuate surface portions of the outer sections 322. However, in order for the belt 334 to be effective as a reinforcing member, reinforcement provided by the belt 334 must be applied to the arcuate exterior surfaces of the side walls of substantially the entire longitudinally extending portion of each section 322, 324. The embodiment of FIG. 5A includes substantially incompressible shims 330 that are disposed in the substantially triangular voids formed between the outer sections 322 and the intermediate section 324. The outer, back surfaces of shims 330 create a planar belt contact surface 328 at a level substantially equal to the height of the outer arcuate surface of each section above each interface 326. The resulting structure enables the filament-wound belt 334 to effectively reinforce the longitudinally extending arcuate side walls of sections 322, 324 which are physically removed from belt 334. In FIG. 5B, the planar belt contact surface 328 is achieved by flattening the longitudinally extending side wall portions of end sections 322 and intermediate section 324 interior to the laterally outermost semicircular side wall areas, and extending the internal ribs or interfaces 326 outwardly.

Figure 6:
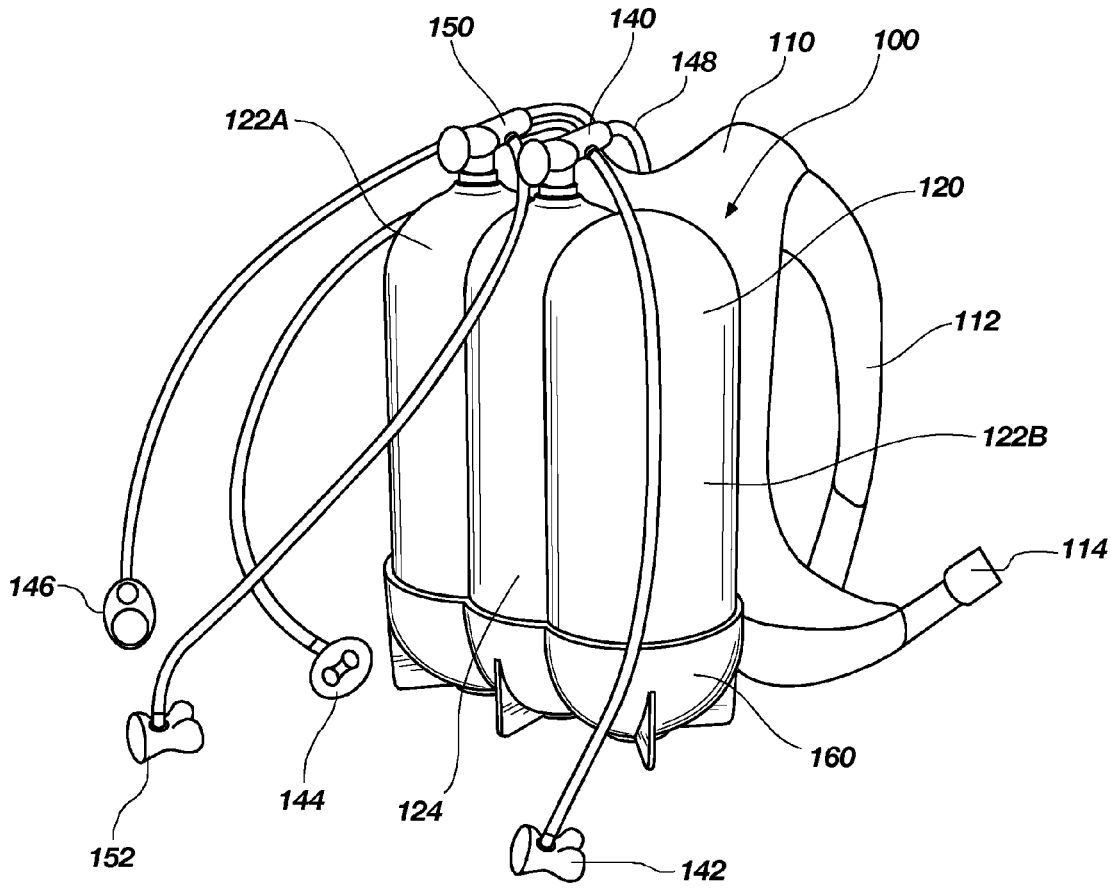
FIG. 6 is a perspective view of an embodiment of a hybrid pressure vessel of the present invention installed on a buoyancy compensator vest.

FIG. 6 depicts an embodiment of a pressure vessel 100 configured for SCUBA diving. The metal, multi-section body 120 is attached to a diving vest or buoyancy compensator BC 110. The BC 110 adjusts the diver's buoyancy while underwater using weights integrated into the vest and an internal air bladder which may be filled using pressurized air supplied by the pressure vessel 100 via hose 148, or with a mouthpiece (not shown) on the front of the BC 110. The BC 110 is fitted to the diver with shoulder straps 112 and a waist belt 114. The pressure vessel 100 includes three sections, in the form of two outer lobes or sections 122 and an intermediate section 124. As shown, outer sections 122A and 122B and the intermediate section 124 are in mutual communication and supply the primary breathable air. Air is distributed from the intermediate section 124 via primary valve 140. Multiple accessories are attached to the primary valve 140 including a primary mouthpiece or regulator 142 configured to discharge air on demand to the diver at ambient pressure, a backup or "octopus" regulator 144 which can be used by the diver if the primary regulator 142 fails or can be offered to another diver requiring air, and a pressure gauge 146 which may also include a dive computer. In a variation of the structure depicted in FIGS. 2 and 3A-C, another regulator 152 is shown in communication with valve 150 affixed in a valve port (not shown) in the end of section 122A for potential use by another diver. Elastomeric boot 160 is configured to engage and protect the bottom of cast body 120 and stabilize the system when disposed on a support surface.

In comparison to conventional pressure vessels configured as air tanks for SCUBA applications, embodiments of the present invention provide obvious advantages. For example, conventional aluminum air tanks operable at 3000-3300 psi service pressure and providing a 77.4 cubic foot air capacity, have an O.D. of 7.25 inches and a length between approximately 26.8 inches and 26.1 inches, with weights between about 31.4 lbs. and 35.4 lbs. These tanks also provide positive buoyancy. In contrast, an embodiment of the pressure vessel of the present invention, cast of an aluminum alloy and operable at 3300-4350 psi service pressure and providing a 78.6 to 103.6 cubic foot air capacity, employs three semi-cylindrical sections each having an O.D. of 6 inches for a total width of less than 18 inches, a length of 17 inches and a total weight of 33.5 lbs. This pressure vessel also offers neutral buoyancy. Thus, the present invention offers the capability of a lower profile and a significantly reduced length in comparison to conventional designs, at a similar weight, with superior capacity and more favorable buoyancy characteristics.

While the invention is susceptible to various modifications and alternative forms which will be readily apparent to those of ordinary skill in the art, specific embodiments have been shown by way of example in the drawings and have been described in detail herein. However, it should be understood that the invention is not intended to be limited to the particular forms disclosed. Rather, the invention includes all additions, deletions and modifications, as well equivalents, and alternative implementations falling within the scope of the invention as defined by the following appended claims and their legal equivalents.

What is claimed is:

1. A pressure vessel comprising:

at least two longitudinally extending sections, each including a side wall, a first substantially hemispherical end wall, and a second substantially hemispherical end wall;

a first rib formed between the at least two sections and including at least one aperture extending therethrough; and the first rib and each side wall, first end wall, and second end wall of the at least two sections collectively forming a seamless, unitary structure of a metal material.

2. The pressure vessel of claim 1, wherein:

the at least two sections comprise two semi-cylindrical sections; and the pressure vessel further comprises at least one intermediate section disposed laterally between the semi-cylindrical sections, the first rib located between a first semi-cylindrical section of the semi-cylindrical sections and the at least one intermediate section, a second rib located between a second semi-cylindrical section of the semi-cylindrical sections and the at least one intermediate section, and the second rib comprising at least one aperture extending therethrough.

3. The pressure vessel of claim 2, wherein a transverse cross-section of the at least one intermediate section is substantially one of a square, a rectangle, and a trapezoid.

4. The pressure vessel of claim 2, wherein center points of the semi-cylindrical sections and the at least one intermediate section lie substantially in a common plane.

5. The pressure vessel of claim 2, wherein center points of the semi-cylindrical sections and the at least one intermediate section lie substantially in an arc.

6. The pressure vessel of claim 2, wherein the side walls of the semi-cylindrical sections are of a thickness different than a thickness of the first end wall and the second end wall thereof.

7. The pressure vessel of claim 6, wherein the thickness of the side walls is greater than the thickness of the first end wall and the second end wall.

8. The pressure vessel of claim 6, wherein the thickness of the side walls is less than the thickness of the first end wall and the second end wall.

9. The pressure vessel of claim 1, wherein:

the at least one aperture extending through the first rib comprises a first aperture; and the first rib further comprises a thickened, reinforcing collar extending around the perimeter of the first aperture.

10. The pressure vessel of claim 9, wherein:

the at least one aperture extending through the first rib comprises a second aperture; and the first rib further comprises a thickened, reinforcing collar extending around the perimeter of the second aperture.

11. The pressure vessel of claim 2, wherein:

the first end of the first semi-cylindrical section comprises an aperture extending therethrough and sealed by a first plug; and the first end of the second semi-cylindrical section comprises an aperture extending therethrough and sealed by a second plug.

12. The pressure vessel of claim 11, wherein:

a first intermediate section of the at least one intermediate section comprises a first end; and the first end of the first intermediate section comprises an aperture extending therethrough.

13. The pressure vessel of claim 12, further comprising a value sealing the aperture extending through the first end of the first intermediate section.

14. The pressure vessel of claim 13, wherein the first end of the first intermediate section is positioned opposite the first ends of the first and second semi-cylindrical sections.

15. A pressure vessel comprising:

at least two sections, each section thereof comprising a side wall, a first end wall, and a second end wall;

a first rib located between the at least two sections;

the first rib and each side wall, first end wall, and second end wall of the at least two sections collectively forming a seamless, unitary structure of a metal material; and at least one opening placing a first section of the at least two sections in fluid communication with a second section of the at least two sections.

16. The pressure vessel of claim 15, wherein a first opening of the at least one opening extends across the first rib.

17. The pressure vessel of claim 16, wherein the at least two sections comprise two semi-cylindrical sections.

18. The pressure vessel of claim 17, further comprising at least one intermediate section disposed laterally between the two semi-cylindrical sections.

19. The pressure vessel of claim 18, wherein:

the first rib is located between one of the two semi-cylindrical sections and the at least one intermediate section; and a second rib is located between another of the two semi-cylindrical sections and the at least one intermediate section.

20. The pressure vessel of claim 19, wherein a second opening of the at least one opening extends across the second rib.

21. The pressure vessel of claim 20, wherein the intermediate section comprises a side wall, first end wall, and second end wall.

22. The pressure vessel of claim 21, wherein the first and second end walls of each the at least two sections and the intermediate section are substantially hemispherical.

23. The pressure vessel of claim 22, wherein the first rib, second rib, and each side wall, first end wall, and second end wall of the at least two sections and the intermediate section collectively form a seamless, unitary structure of a metal material.

24. A pressure vessel defining longitudinal, lateral, and transverse directions extending substantially orthogonal to one another, the pressure vessel comprising:

at least two sections extending in the longitudinal direction, each section of the at least two sections comprising a side wall, a first substantially hemispherical end wall, and a second substantially hemispherical end wall;

a rib located between the at least two sections;

the rib and each side wall, first substantially hemispherical end wall, and second substantially hemispherical end wall of the at least two sections collectively forming a seamless, unitary structure of a metal material;

at least one opening placing a first section of the at least two sections in fluid communication with a second section of the at least two sections; and the at least one opening comprising a first opening extending in the lateral direction across the rib.

25. The pressure vessel of claim 24, wherein the rib further comprises a thickened, reinforcing collar extending around the perimeter of the first opening.

26. The pressure vessel of claim 25, wherein:

the at least one opening further comprises a second opening extending in the lateral direction across the rib; and the rib further comprises a thickened, reinforcing collar extending around the perimeter of the second opening.

* * * * *